US005406466A

United States Patent [19]

Stokes

[11] Patent Number: 5,406,466

[45] Date of Patent: Apr. 11, 1995

[54] DECORATIVE OUTDOOR LIGHT

[76] Inventor: Dana A. Stokes, 2666 Minton Ct., Pleasanton, Calif. 94588

[21] Appl. No.: 279,812

[22] Filed: Jul. 18, 1994

Related U.S. Application Data

[63] Continuation of Ser. No. 89,789, Jul. 9, 1993, Pat. No. 5,331,527, which is a continuation-in-part of Ser. No. 989,077, Dec. 11, 1992, Pat. No. 5,226,721.

[51] Int. Cl.[6] ..... F01F 9/00

[52] U.S. Cl. ..... 362/153.1; 362/431; 362/159; 362/805

[58] Field of Search ..... 362/153.1, 153, 161, 362/172, 173, 362, 431, 805, 806

[56] References Cited

U.S. PATENT DOCUMENTS

| | | | |
|---|---|---|---|
| 1,045,253 | 11/1912 | Brown | 362/152 |
| 3,833,804 | 9/1974 | Vesely | 362/431 X |
| 4,321,656 | 3/1982 | Gruver, Jr. | 362/159 X |
| 4,360,862 | 11/1982 | Strasser et al. | 362/362 X |
| 4,774,648 | 9/1988 | Kakuk et al. | 362/431 X |
| 4,996,636 | 2/1991 | Lovett | 362/431 |
| 5,029,054 | 7/1991 | Trainor | 362/153.1 |
| 5,178,450 | 1/1993 | Zelensky et al. | 362/805 X |

*Primary Examiner*—Larry Jones
*Attorney, Agent, or Firm*—Schapp and Hatch

[57] ABSTRACT

A garden light in which the base is a segment of natural bamboo, the globe surrounding the incandescent lamp is a transparent food jar, and the shade includes an inverted rice bowl and an inverted wooden salad plate both of which are cemented to the bottom flange of the food jar. The lamp is mounted in a garden by burying or driving its butt into the ground.

3 Claims, 3 Drawing Sheets

DECORATIVE OUTDOOR LIGHT

This is a continuation of application Ser. No. 08/089,789 filed on Jul. 9, 1993, now U.S. Pat. No. 5,331,527 issued on Jul. 19, 1994 which is a continuation-in-part of Ser. No. 07/989,077, filed on Dec. 11, 1992, now U.S. Pat. No. 5,226,721, issued on Jul. 13, 1993.

BACKGROUND OF THE INVENTION

Field of the Invention

My present invention relates to outdoor lighting devices, and more particularly to electrical outdoor lighting devices.

Electrical outdoor lighting devices have long been known in the prior art. However, many if not all of the electrical mechanical appearance, rather than a natural appearance, make an unpleasing and unaesthetic contrast with their vegatational surroundings, and thus emphasize themselves to the eye and detract from the overall appearance of the garden or other natural or cultivated plant setting in which they appear.

Further, many of these prior art outdoor lighting devices, or at least parts thereof, consist of metallic or plastic shells, which are easily damaged by powered, or even unpowered, garden tools and the like.

Yet further, these prior art outdoor lighting devices in general must be entirely replaced when thus damaged by powered or unpowered garden tools or the like to avoid a very unsightly appearance.

Additionally, many of these prior art outdoor lighting devices are so fabricated from plastic or sheet metal parts that they can not easily be modified to blend into the surroundings of the owner's particular garden.

It is to be understood that the term "prior art" as used herein or in any statement made by or on behalf of applicant means only that any document or thing referred to as prior art bears, directly or inferentially, a date which is earlier than the effective filing date hereof.

No representation or admission is made that any of the outdoor lighting devices referred to above is part of the prior art, or that a search has been made, or that no more pertinent information exists.

SUMMARY OF THE INVENTION

Accordingly, it is an object of my present invention to provide outdoor lighting devices the appearance of which is more naturalistic than that of prior art outdoor lighting devices, and which thus blend more naturally with their garden surroundings or the like, and present a pleasing naturalistic appearance.

Another object of my present invention is to provide outdoor lighting devices the main bodies of which not only present a naturalistic appearance but also are highly resistant to impact by manual or power operated garden tools or the like.

Yet another object of my present invention is to provide outdoor lighting devices which are largely fabricated from naturally occurring materials, or from products which are cheaply and widely available for other purposes, resulting in unique products which are readily manufactured from existing components, and thus are inexpensively manufacturable.

A yet further object of my present invention is to provide outdoor lighting devices which are comprised in substantial part of existing components manufactured for other purposes, whereby to product the ecology by obviating the construction and operation of new manufacturing facilities.

A yet further object of my present invention is to provide outdoor lighting devices which can readily be modified by the user thereof so as to make available to the user unique outdoor illuminating devices to be found in no other gardens thereby contributing to the user's satisfaction in his or her garden.

Other objects of my present invention will in part be obvious and will in part appear hereinafter.

My present invention, accordingly, comprises the apparatus embodying features of constructions, combinations of elements, and arrangements of parts, all as exemplified in the following disclosures, and the scope of my present invention will be indicated in the claims appended hereto.

In accordance with a principal feature of my present invention, outdoor illuminating device are provided in which the base or principal body part is a short section of bamboo.

In accordance with another principal feature of my present invention, outdoor lighting devices are provided in which said principal body part or base is coated with a natural appearing coating which is resistant to weathering and at the same time is resistant to exposure to the soil in which the lower end or butt thereof is implanted.

In accordance with another principal feature of my present invention, an outdoor lighting device is provided in which the globe or transparent part is a glass jar of well known type, which can be replaced by the owner when accidentally broken without searching for a new part, which new part may be unavailable, or may be available only as part of a complete new outdoor lighting device.

Yet another principal feature of my present invention is to provide an outdoor lighting device the shade portion of which is fabricated from well known and widely available articles, such as a ceramic bowl and a wooden salad plate, which articles are already manufactured and do not involve the ecological impact of the creation and operation of new manufacturing facilities.

Another principal feature of my present invention is the provision of outdoor lighting devices the shade portions of which are fabricated from already manufactured components, such as ceramic bowls and wooden salad plates, whereby a minimally creative owner can modify the shade portion to present a new appearance unique only to his or her own garden.

For a fuller understanding of the nature and objects of my present invention reference should be had to the following detailed description, taken in connection with the accompanying drawings.

DESCRIPTION OF THE PREFERRED EMBODIMENTS

Figure 1:
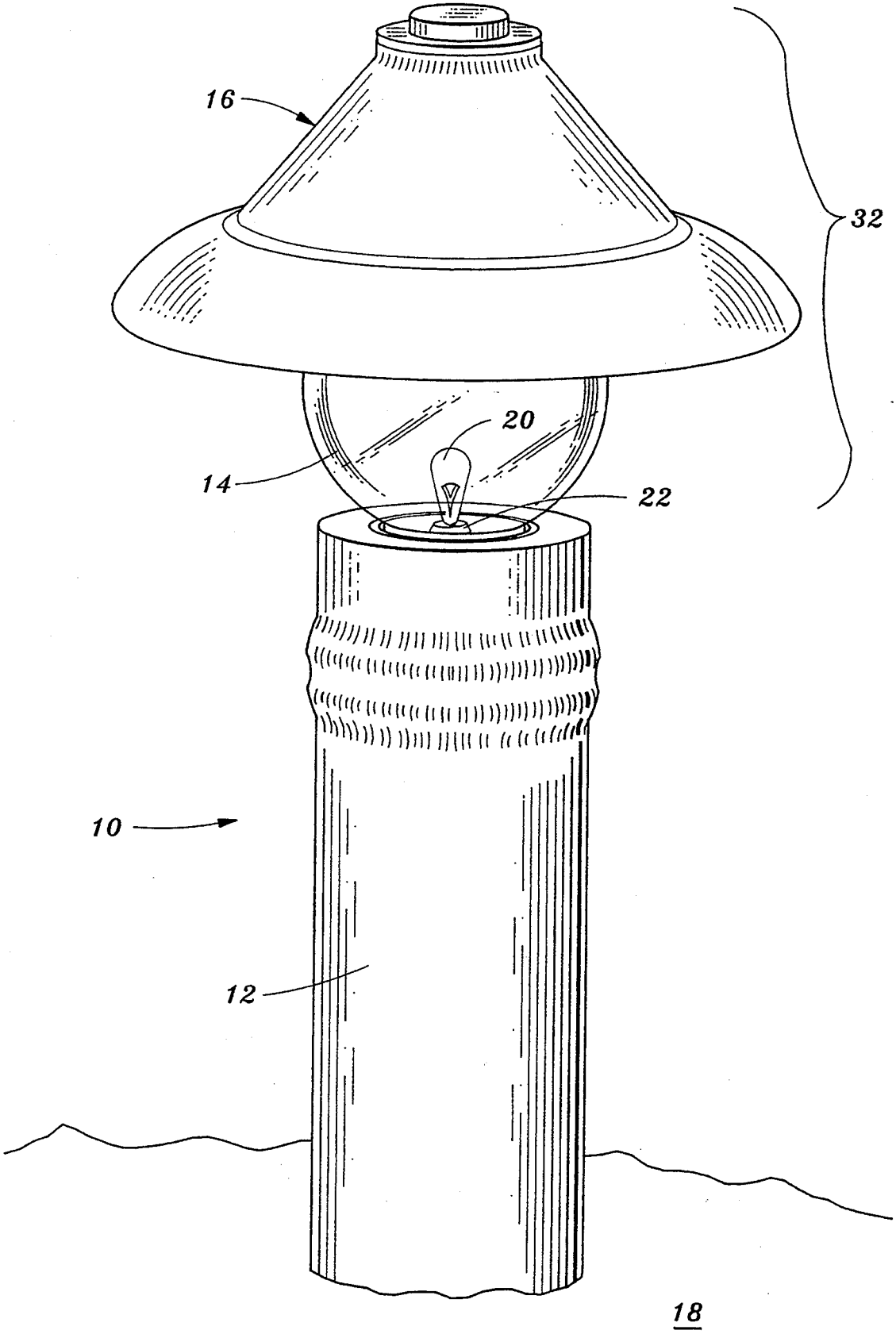
FIG. 1 is a perspective view of an outdoor lighting device constructed in accordance with the preferred embodiment of my present invention.

Referring now to FIG. 1, there is shown an outdoor lighting device or garden light 10 of the preferred embodiment of my invention.

As seen in FIG. 1, garden light 10 of my invention is comprised of a main body portion or base 12, a globe 14, and a shade 16.

As also seen in FIG. 1, garden light 10 is maintained in position in the earth 18 of a garden by burying the lower end of base 12 in earth 18.

As further seen in FIG. 1, globe 14 is substantially transparent, and contains an incandescent lamp 20, which incandescent lamp is mounted in a socket 22 which is fixedly positioned in the upper end of base 12.

Figure 1A:
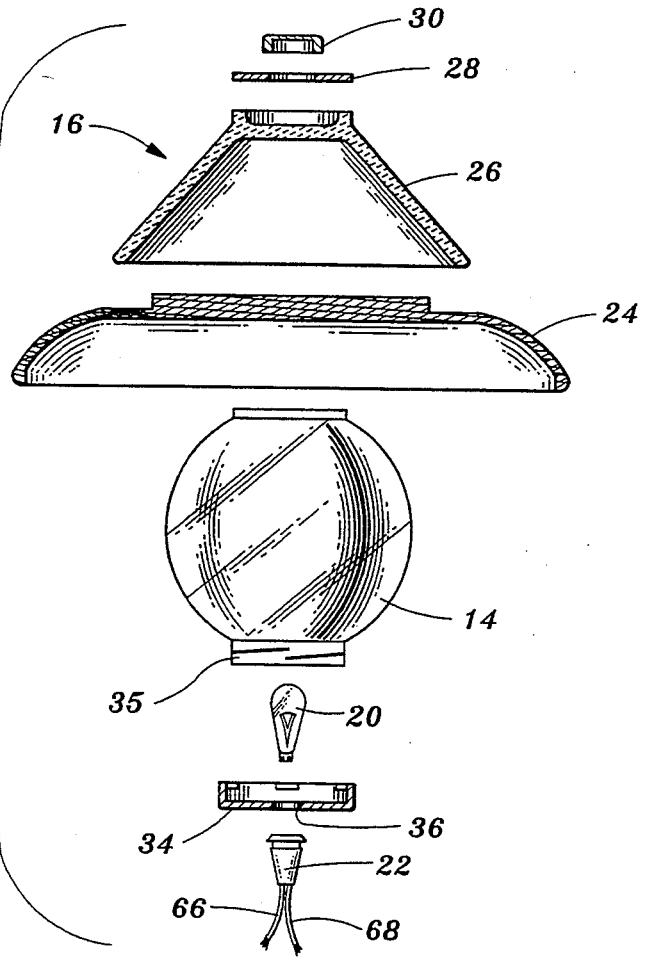
FIG. 1A is an exploded view, partly in section, of the portion of the outdoor lighting device of FIG. 1 extending above the base thereof.

Referring now to FIG. 1A, it will seen that shade 16 is comprised of an inverted wooden salad plate 24, and inverted rice bowl 26, a decorative washer 28, and a decorative cap 30.

In accordance with the principles of my invention shade 16 is fabricated by cementing together salad bowl 24, rice bowl 26, washer 28 and cap 30, as with epoxy cement.

As will be evident to those having ordinary skill in the art, informed by the present disclosure, the provision of a suitable fixture for maintaining salad plate 24, rice bowl 26, washer 28 and cap 30 in alignment during the setting of the layers of cement which join them is well within the scope of one having ordinary skill in the art, without the exercise of invention or undue experimentation.

Both plate 24 and bowl 26 may be fabricated from other materials, such as wood or plastic and colored in accordance with desired artistic or visual effects.

As further seen in FIG. 1A, globe 14 is a simple jelly or jam jar of well known type, widely available at low cost, the bottom flange of which is cemented to the central portion of the inner face of salad plate 24, as by suitable epoxy cement.

A plastic jar may instead be used as globe 14, or a combination of glass and plastic, transparent or translucent.

In accordance with the principles of my invention globe 14 may be cemented to salad plate 24 during the same cementing operation in the course of which the components 24, 26, 28, and 30 of shade 16 are being cemented together.

This cemented-together combination of globe 14 and shade 14 will sometimes hereinafter be called the "lamp cover assembly" of my invention, and will be designated by the reference numeral 32 (FIG. 1).

Washer 28 and cap 30 may take any form dictated by considerations of appearance, cost, etc., and be of any color and finish comporting with the other parts of the lamp cover assembly.

As further seen in FIG. 1A, a suitable jar lid 34 adapted to cooperate with the upper flange 35 of the transparent jar which is globe 14 is provided with a centrally located circular opening 36. Central opening 36 is of such size as to accommodate the resilient upper part of lamp socket 22, which can be affixed in opening 36 by merely pressing socket 22 against the upper central portion of jar lid 34 until the resilient outer flange of socket 22 passes through opening 36, and thus socket 22 becomes captive in opening 36, with its lamp-receiving cavity having the same direction of concavity as jar lid 34.

Both lamp 20 and lamp socket 22 are widely commercially available electrical system components, often found in automobile supply stores.

Figure 1B:
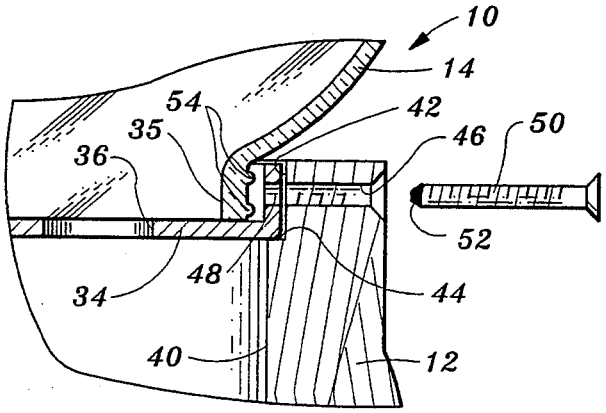
FIG. 1B is a partial sectional view of the outdoor lighting device of FIG. 1 illustrating the safety means provided for securing the globe portion thereof in the base portion thereof.

Referring now to FIG. 1B, there is shown a partial sectional view of the upper end of base 12, into which is inserted jar lid 34 and the threaded flange 35 of globe 14.

It should be noted that lamp socket 22 has been removed from the central opening 36 of jar lid 34 for clarity of illustration.

As further seen in FIG. 1B, base 12 is fabricated from natural wood, and more particularly from bamboo, and is provided with an internal cylindrical bore 40. As is well known to those having ordinary skill in the art who are aquainted with bamboo fabrication, old growth bamboo often occurs in substantially cylindrical form, including such an internal bore as bore 40.

As further seen in FIG. 1B, the upper end of bamboo base 12 is provided, as by machining, with an enlarged internal bore 42 of limited extent or depth, which bore terminates at its lower end in an internal shoulder 44.

As also may be seen from FIG. 1B, the diameter of short bore 44 is slightly greater than the diameter of jar lid 44, and the length or depth of bore 42 is substantially equal to the flange height of jar lid 36.

Thus, it will be seen by those having ordinary skill in the art, informed by the present disclosure, that jar lid 34 is close-fittingly received in bore 42, with its main outer face portion in contact with shoulder 44.

It may be found desirable to cement jar lid 34 to the wall of bore 42, or to shoulder 44, or both. However, it will be found preferable to affix lamp socket 22 in opening 36 before thus cementing jar lid 34 in bore 42.

It is to be understood, however, that my invention is not limited to embodiments including enlarged bore 42 and shoulder 44, but also embraces embodiments in which jar lid 36 is fixedly secured in main bore 40.

As yet further seen in FIG. 1B, a tapped hole 46 extends through body 12 from the outer surface thereof to the cylindrical surface of bore 42, and a circular hole 48 is provided in the flange portion of jar lid 34. Circular opening 48 is adapted to receive the shank of a screw 50, which is preferably provided at its outer end with a resilient tip or pad 52.

As will now be evident to those having ordinary skill in the art, informed by the present disclosure, screw 50, when threadedly engaged in bore 46, can be rotated clockwise until it passes through opening 48 in the flange portion of jar lid 34, and then further rotated in the same direction until soft tip 52 engages with the partial threads 54 of flange 35 of globe 14. Thus, in accordance with the present invention, globe 14 can be secured in bore 42 in the upper end of base 12, whereby to prevent the removal of globe 14 from base 12 by a curious child, and thus to protect such a child from contact with incandescent lamp 20 and the internal connections of lamp socket 22.

In certain preferred embodiments of my invention two additional tapped holes 46', 46" and screws 50', 50" may be provided, the tapped holes 46, 46', 46" being equiangularly spaced about the axis of bore 40.

Figure 1C:
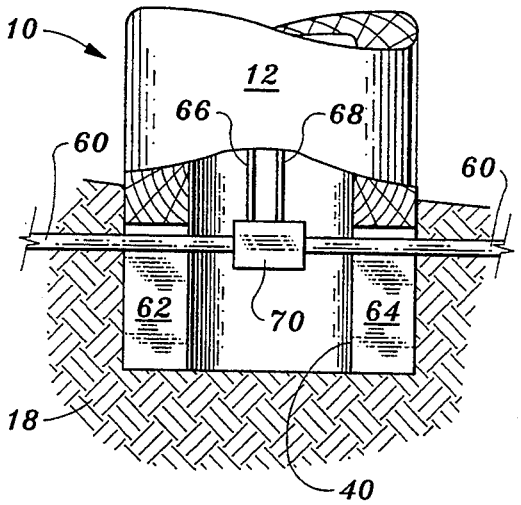
FIG. 1C is an elevational view, partly in section, of the lower end of the base portion of the outdoor illuminating device shown in FIG. 1.

Referring now to FIG. 1C, there is shown in partial cross-section the lower end or butt of base 12.

As explained hereinabove, the lower end or butt of base 12 is buried in the earth 18 of a garden or the like in which is buried an electrical cable 60 which is itself connected to a 12-volt, switched, electrical supply source.

Figure 2:
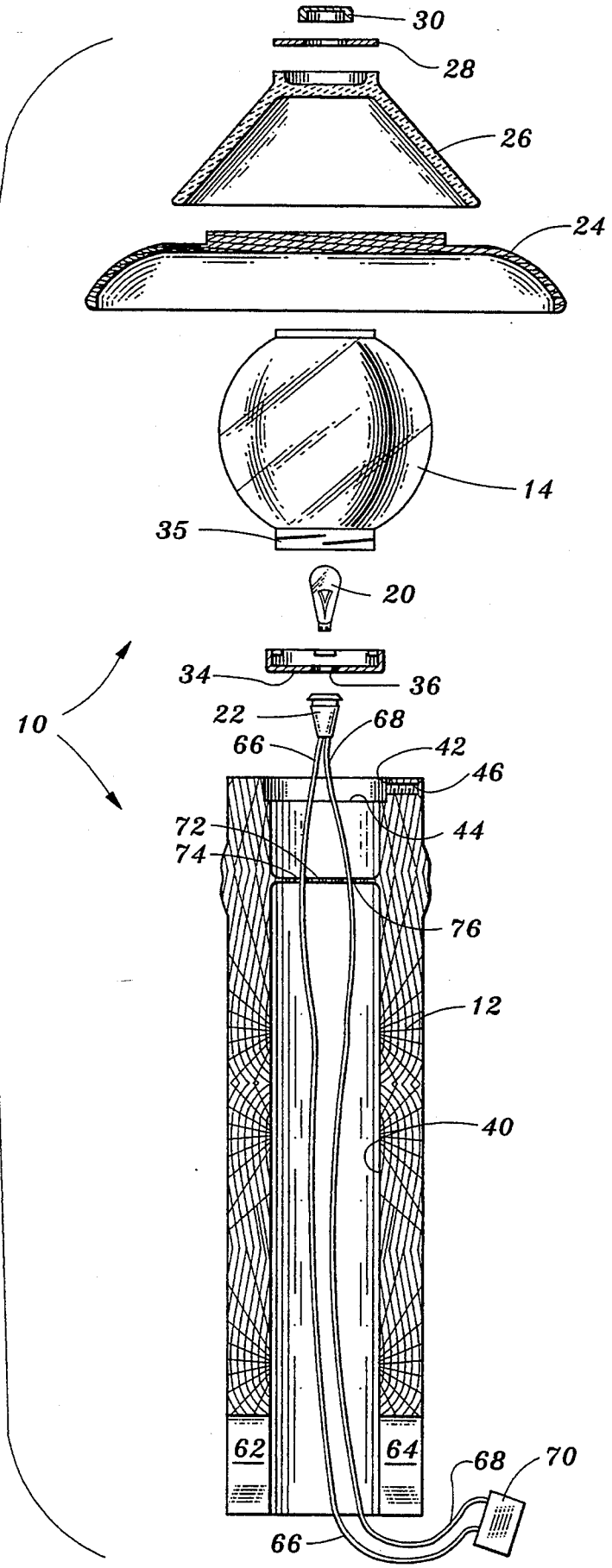
FIG. 2 is an exploded elevational view, partly in section, of the outdoor lighting device of the present invention shown in FIG. 1.

As seen in FIG. 1C and also in FIG. 2, a pair of diametrically opposed slots 62, 64 are provided in the butt of base 12 for the purpose of conveniently receiving an electrical cable such as cable 60.

It is to be understood that the provision of such slots 62, 64 may not be found necessary in all embodiments of my invention.

Referring again to FIG. 1C, there is seen within bore 40 a pair of insulated wires 66, 68.

Comparing FIG. 1A with FIG. 1C, it will be seen that insulated wires 66, 68 extend from lamp socket 22 to a location near the lower end of bore 40.

Returning to FIG. 1C, it will be seen that a cable clamp connector 70 of well known type is connected to the lower ends of both insulated wires 66, 68.

Cable clamp connector 70 is of the well known type which is adapted to automatically make connection between a pair of individual insulated wires and corresponding ones of the conductors of a cable, such as cable 60.

Thus, it will be understood that garden light 10 may be simply and quickly connected to power supply cable 60 by positioning a completely unprepared part of cable 60 between the jaws of clamp connector 70, squeezing those jaws together and locking them together, all in the well known manner.

While, as shown in FIG. 1C, cable clamp connector 70 is located within the lower end of bore 40 when insulated wires 66, 68 are fully extended, it is to be understood that in certain embodiments of my invention it may be found preferable to somewhat elongated insulated wires 66, 68, so that cable clamp connector 70 is located outside the lower end of bore 40, making it easier for users in some cases to position cable 60 within the jaws of cable clamp connector 70, and to close those jaws. An embodiment of this kind is shown in FIG. 2.

Referring now to FIG. 2, there is shown an exploded elevational view, partly in section, of the complete garden light 10 of the first preferred embodiment of my present invention.

As shown in FIG. 2, the natural bamboo segment which is base 12 includes a naturally occurring transverse partition 72. In manufacturing the device of the first preferred embodiment a pair of holes 74, 76 are made through partition 72, one to accommodate insulated wire 66 and the other to accommodate insulated wire 68.

In FIG. 2 insulated wires 66, 68 project beyond the lower end of bore 40, and thus cable clamp 70 can easily be closed over an existing electrical supply cable, which supply cable is then passed into slots 62, 64, and wires 66, 68 tucked into bore 40, whereupon the butt of base 12 is driven into a hole in the ground or pushed in a previously made hole, and a bolus of returned earth tamped therearound.

It is to be noted that for the purpose of driving base 12 into soft ground lamp socket 22 can be conveniently deposited in the cavity existing above partition 72, whereupon cable clamp 70 is applied to an existing electrical cable, said electrical cable is then passed into slots 62, 64, and base 12 is then driven into the ground.

Lamp socket 22 can then be raised from that cavity and its upper end manually inserted into hole 36 in jar lid 34. Jar lid 34 can then be dropped on shoulder 44.

After thus dropping jar 34 on shoulder 44, incandescent lamp 20 is then inserted into lamp socket 22, and globe 14, as the lowest part of lamp cover assembly 32, is dropped over lamp 22 so that its flange 35 interfits with jar lid 34 and the lugs raised therein, whereupon a quarter turn of lamp cover assembly 32 about the axis of base 12 secures lamp cover assembly 32 to jar lid 34. A suitable screw is then threaded into threaded bore 46, and when this screw is brought into contact with flange 35 between a pair of partial threads 54, the parts of garden light 10 are locked together against disturbance by curious children.

In a partial version of the preferred embodiment incandescent lamp 20 is a Phillips 12.5-watt wedge base incandescent lamp, lamp socket 22 is an automotive side marker assembly socket sold by Calterm, Inc. under the commercial designation 08591, and cable clamp lock 70 is a FAST-LOCK cable connector made and sold by the Intermatics Corporation.

As is well known, nature old growth bamboo such as base 12 is characterized by a high degree of termite resistance and moisture resistance, and thus can be expected to remain in soils of virtually any type for many years without substantial degradation.

An exterior latex coating is preferably applied to all of the exposed surfaces of base 12, inside and out.

In certain embodiments of my invention base 12 may alternatively be fabricated from any material configured to simulate bamboo, and may be painted or coated in other colors than that of natural bamboo.

It will thus be seen that the objects set forth above, among those made apparent from the preceding description, are efficiently attained, and since certain changes may be made in the above constructions and the method carried out thereby without departing from the scope of the present invention, it is intended that all matter contained in the above description or shown in the accompanying drawings shall be interpreted as illustrative only, and not in a limiting sense.

It is also to be understood that the following claims are intended to cover all of the generic and specific features of my invention hereindescribed, and all statements of the scope of my invention which, as a matter of language, might be said to fall therebetween.

What is claimed is:

1. A decorative outdoor light, comprising:

a base member having the external appearance of a section of a bamboo stem;

a jar having a neck and a lid with a central hole in the lid;

a first generally plate-shaped food receptacle having a predetermined depth and an outer rim; and a second food receptacle which is deeper than said first food receptacle and the outer rim of which is of lesser diameter than the diameter of the outer rim of said first food receptacle;

said base member being hollow and open at both ends and the diameter of one end thereof being such as to close-fittingly receive said lid;

said lid being fixedly maintained in said one end of said base member;

an incandescent lamp socket mounted in said central hole and passing through said lid; and said jar and said first and second food receptacles being adhered together to provide a unitary lamp shade and lamp globe.

2. A decorative outdoor light as claimed in claim 1, further comprising a threaded bore passing through the wall of said base member, and a screw engaged in said threaded bore and passing through an opening in the sidewall of said lid to lock the neck of said jar in said lid and to lock said lid in said base member.

3. A decorative outdoor light as claimed in claim 1 in which said base member is provided with an outer surface in a color other than that of natural bamboo.

* * * * *